United States Patent [19]

Hiraki et al.

[11] Patent Number: 4,919,093

[45] Date of Patent: Apr. 24, 1990

[54] INTERNAL COMBUSTION ENGINE

[75] Inventors: Hikosaburo Hiraki; Toshibumi Murakami; Akira Kusakabe, all of Tochigi, Japan

[73] Assignee: Kabushiki Kaisha Komatsu Seisakusho, Tokyo, Japan

[21] Appl. No.: 340,724

[22] PCT Filed: Apr. 7, 1988

[86] PCT No.: PCT/JP88/00350

§ 371 Date: Dec. 5, 1988

§ 102(e) Date: Dec. 5, 1988

[87] PCT Pub. No.: WO88/08081

PCT Pub. Date: Oct. 20, 1988

[30] Foreign Application Priority Data

Apr. 7, 1987 [JP] Japan ..... 62-51673[U]
Dec. 3, 1987 [JP] Japan ..... 62-183817[U]

[51] Int. Cl.[5] ..... F02M 61/04
[52] U.S. Cl. ..... 123/299; 239/533.4
[58] Field of Search ..... 123/299, 300; 239/533.1, 533.2, 533.3, 533.4, 533.5, 533.6, 533.7, 533.8, 533.9, 533.10, 533.11, 533.12, 585

[56] References Cited

U.S. PATENT DOCUMENTS 4,285,471 8/1981 Eblen et al. ..... 239/533.4
4,526,323 7/1985 Seifert ..... 239/533.4 X
4,546,739 10/1985 Nakajima et al. ..... 123/299
4,548,172 10/1985 Bailey ..... 123/299 X
4,733,643 3/1988 Ishida ..... 123/299 X

FOREIGN PATENT DOCUMENTS 1076045 10/1954 France ..... 123/299
0228766 11/1985 Japan ..... 123/299

*Primary Examiner*—Willis R. Wolfe
*Attorney, Agent, or Firm*—Varndell Legal Group

[57] ABSTRACT

The present invention provides an internal combustion engine including an injection nozzle for injecting fuel. The injection nozzle is formed with a plurality of injection holes arranged in two rows concentrically relative to the center axis (L) of the injection nozzle. The injection holes in the upper row are arranged in a zigzag fashion relative to those in the lower row. Radially extending center axes (P) of the respective injection holes in the upper row are arranged on the periphery of a circle of which center is located at a position (O) on the center axis (L) of the injection nozzle, while radially extending center axes (P) of the respective injection holes in the lower row are arranged on the periphery of a circle of which center is located at a position (O) on the center axis (L) of the injection nozzle. The position (O) is spaced away from the position (O) by a predetermined distance (Z).

4 Claims, 7 Drawing Sheets

INTERNAL COMBUSTION ENGINE

TECHNICAL FILED

The present invention relates to an internal combustion engine and more particularly to an internal combustion engine including a fuel injection device.

BACKGROUND ART

In general, to assure that an internal combustion engine has an increased combustion efficiency and an increased output, it is required that it has an improved combustion matching. To have such an improved combustion matching, items required particularly for a fuel injection system are such that a period of time for injecting a required amount of fuel is shortened as far as possible and moreover uniformity of distribution of sprayed fuel in a combustion chamber is improved further.

Hitherto, a nozzle in the fuel injection device used for a conventional internal combustion engine, particularly for a conventional high speed diesel engine is usually so designed that a plurality of injection holes formed at the fore end part of the injection nozzle are arranged in a single row on the periphery of a circle of which center coincides with a center axis of the injection nozzle which has 4 to 6 injection holes formed thereon so that combustion matching and uniformity of distribution of injected fuel are improved. However, required performances fail to be attained at present.

To assure that a period of fuel injection time is shortened further to improve combustion matching with such a high speed diesel engine, it has been considered that respective injection holes formed at the fore end part of the injection nozzle should preferably have an enlarged diameter, in other words, have an increased total area. However, when the injection holes have an increased total area merely by enlarging their diameter, it has been found that a streaming force generated by fuel injection becomes excessively intense, then this causes fuel injection to be achieved in a deviated state on a periphery area of the combustion chamber and this leads to a high magnitude of fluctuation in distribution of injected fuel in the combustion chamber, resulting in a combustion efficiency being reduced adversely. Accordingly an excessively enlarged diameter of the respective injection holes can not contribute to improvement in combustion efficiency with the internal combustion engine and increase in output therefrom.

In addition, it has been considered that when the number of injection holes is increased without any increase in diameter thereof, their total area is likewise increased and this enables a period of fuel injection time to be shortened. However, when the number of injection holes is practically increased, it follows that a distance between adjacent injection holes is reduced and this causes overlapping to occur between successive spray injections even with a reduced intensity of swirl in the combustion chamber, resulting in a high magnitude of fluctuation in distribution of sprayed fuel appearing in the combustion chamber. Accordingly, the conventional internal combustion engine can not improve a combustion efficiency thereof and increase an output therefrom irrespective of how much the number of injection holes is immoderately increased.

On the other hand, with the foregoing circumstances in mind, the inventors have proposed a fuel injection nozzle under Japanese Utility Model Application NO. 195511/1982 of which purport consists in that an area assumed by injection holes is increased, depth of a cavity is determined more than that of a conventional non-swirl type combustion chamber and a period of fuel injection time is shortened as far as possible to improve uniformity of distribution of sprayed fuel in the combustion chamber.

The injection nozzle proposed under Japanese Utility Model Application NO. 195511/1982 is so designed that a plurality of injection holes are arranged in two upper and lower rows concentrically relative to the center axis of the injection nozzle, center axes of the radially extending injection holes in the upper row coincide with those in the lower row at a single position on the center axis of the injection nozzle and the injection holes in the upper row are arranged in a zigzag fashion relative to those in the lower row. When injection holes are arranged in that way, it follows that the number of injection holes is increased to increase their total area and a period of fuel injection time is shortened. Additionally, since the injection holes are arranged in a zigzag fashion, a danger that overlapping occurs between fuel injections effected through adjacent injection holes is removed as far as possible, resulting in uniformity of distribution of injected fuel being improved as far as possible. The injection nozzle proposed under Japanese Utility Model Application NO. 195511/1982 is shown in FIG. 13 which is a fragmental sectional view illustrating the fore end part of the injection nozzle.

According to the prior invention proposed under Japanese Utility Model Application NO. 195511/1982 as shown in FIG. 13, the injection nozzle is so constructed that a plurality of injection holes arranged in upper and lower rows in a zigzag fashion are formed concentrically relative to the center axis L of the injection nozzle in such a manner that their radially extending center axes P and P'. are converged on a single position 0 on the center axis L. Thus, starting points Q and Q'. of the respective injection holes arranged in the upper and lower rows have a reduced distance therebetween, causing a crack to occur between adjacent injection holes after the injection nozzle is used for a long period of time. Consequently, the injection nozzle has a degraded durability. In other words, the conventional internal combustion engine including the aforementioned injection nozzle has a degraded durability.

The present invention has been made with the foregoing background in mind and its object resides in providing an internal combustion engine which assures that a period of time required for injecting a required amount of fuel is determined as short as possible, uniformity of distribution of sprayed fuel in a combustion chamber is improved further and moreover durability of an injection nozzle is improved further.

Other object of the present invention is to provide an internal combustion engine which assures that a period of fuel injection time is shortened, uniformity of distribution of sprayed fuel in the combustion chamber is improved, depth of a cavity is determined more than that of a conventional non-swirl type combustion chamber and moreover the injection nozzle has an excellent durability.

Another object of the present invention is to provide an internal combustion engine which assures that the cavity serving as a combustion chamber has a shallow-bottomed sectional contour corresponding to an increased output from the engine, a period of fuel injection time is shortened even with such a combustion chamber having a shallow-bottomed sectional contour, uniformity of distribution of sprayed fuel in the combustion chamber is improved and moreover the injection nozzle has an excellent durability.

DISCLOSURE OF THE INVENTION

The present invention provides an internal combustion engine including a fuel injection device wherein a plurality of injection holes are arranged in two rows concentrically relative to the center axis of the injection nozzle, radially extending center axes of the injection holes arranged in the upper row are converged on a single position O located on the center axis of the injection nozzle, radially extending center axes of the injection holes arranged in the lower row are converged at a single position O' located on the center axis of the injection nozzle and spaced away from the position O by a predetermined distance Z and the injection holes in the upper row are arranged in a zigzag fashion relative to the injection holes in the lower row. With such construction that the injection holes in the upper row are arranged on the periphery of a circle of which center is located at a single position on the center axis of the injection nozzle and the injection holes in the lower row are arranged on the periphery of a circle of which center is located at a single position on the center axis of the injection nozzle spaced away from the first-mentioned position by a predetermined distance Z, starting positions of the injection holes in both the two upper and lower rows are spaced away from each other with the result that any crack does not occur between the starting positions of the injection holes arranged in both the upper and lower rows even after the injection nozzle is used for a long period of time. Consequently, the internal combustion engine enjoys an excellent durability.

BEST MODE FOR CARRYING OUT THE INVENTION

Now, the present invention will be described in a greater detail here under with reference to the accompanying drawings which illustrate preferred embodiments thereof.

Figure 1:
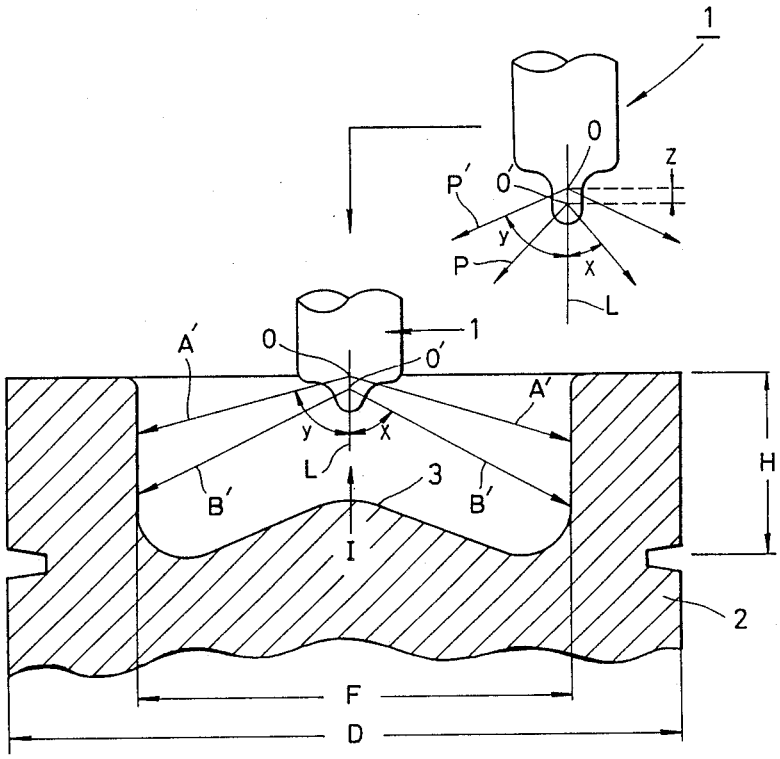
FIG. 1 is a fragmental sectional view illustrating an essential part of an internal combustion engine in accordance with an embodiment of the present invention.

FIG. 1 is a fragmental sectional view illustrating an essential part of an internal combustion engine in accordance with an embodiment of the present invention and particularly illustrating in more details a combustion chamber and an injection nozzle.

This internal combustion engine is a direct fuel injection type diesel engine which includes a piston 2 just beneath an injection nozzle 1. The piston 2 is formed with a cavity at its upper part which constitutes a so-called deep-bottomed tray type combustion chamber 3.

Figure 2:
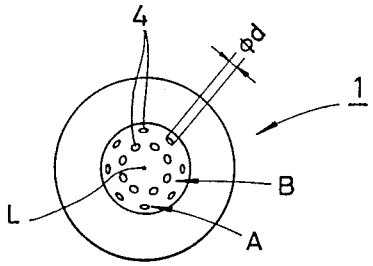
FIG. 2 is a plan view of an injection nozzle as seen in the direction identified by an arrow mark I in FIG. 1.

As will be apparent from FIG. 2 which is a plan view as seen in the direction identified by an arrow mark I in FIG. 1, the injection nozzle 1 is formed with a plurality of injection holes 4 arranged in two rows comprising an upper row A and a lower row B concentrically relative to a center axis L in a zigzag fashion at its foremost end. In addition, as will be apparent from FIG. 3 which is a sectional view illustrating an essential part of the injection nozzle 1 shown in FIG. 2, the radially extending injection holes 4 arranged in the upper row A are formed at a predetermined pitch on the periphery of a circle of which center is located at a position O on the center axis L, while the radially extending injection holes 4 arranged in the lower row B are formed at a predetermined pitch on the periphery of a circle of which center is located at a position O' on the center axis L spaced away from the position O by a distance Z. Incidentally, in the illustrated embodiment the injection holes 4 having number in the range of 14 to 20 in total are formed while arranged in two rows.

Figure 3:
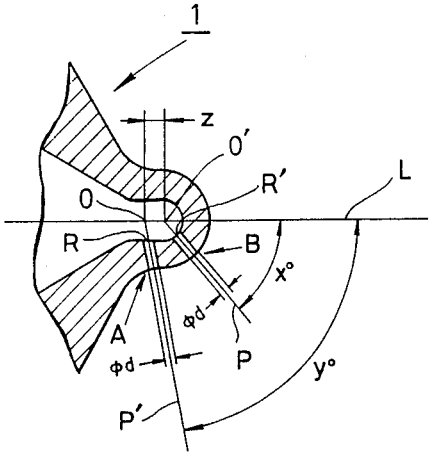
FIG. 3 is a fragmental sectional view illustrating the fore end part of the injection nozzle.

In addition, in the foregoing embodiment, as shown in FIG. 3, the injection centers O and O' in the injection nozzle 1 are spaced away from one another by a distance Z on the center axis L as mentioned above, on the assumption that the fore end part of the injection nozzle 1 assumes a cylindrical configuration. Concretely speaking, the distance Z is determined relative to a diameter d of the respective injection holes 4 in accordance with the following relationship. Namely, $$d < Z < 4d \quad (1)$$

Additionally, in the foregoing embodiment, as shown in FIG. 3, angles assumed relative to the center axis L of the injection nozzle by the center axes P and P'. of the respective injection holes 4 arranged in two upper and lower rows are determined in accordance with the following relationship when an angle assumed for the lower row B is represented by X° and an angle assumed for the upper row A is represented by Y°.

$$45° < X < 60° \quad (2)$$

$$75° < Y < 85° \quad (3)$$

Consequently, fuel injected through the injection holes 4 arranged in two rows is sprayed within a comparatively narrow range extended round the center axis L as identified by arrow marks A' and B' in FIG. 1 and this makes it possible to determine a depth H of the cavity more than that of a conventional non-swirl type combustion chamber.

Incidentally, in the embodiment shown in FIG. 1, the range assumed by a value of diameter of cavity / diameter of bore=F/D is determined in accordance of the following relationship.

$$0.5 < F/D < 0.7 \quad (4)$$

Figure 4:
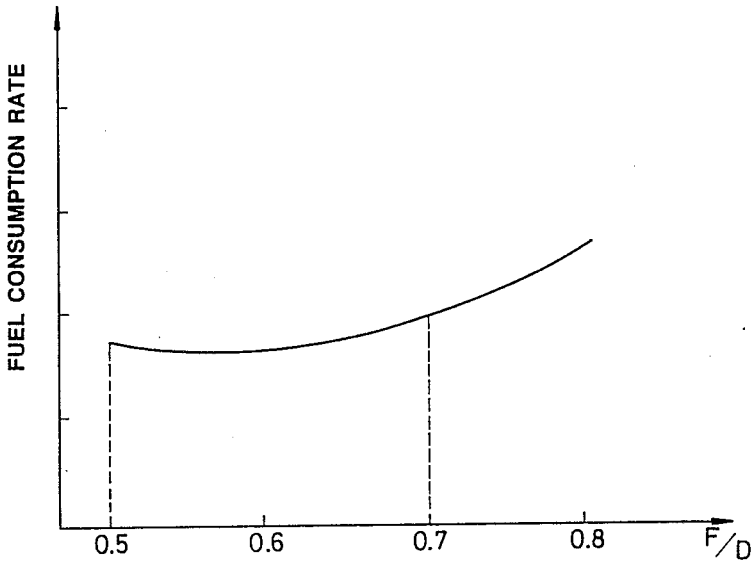
FIGS. 4 to 6 are a graph respectively, representing characteristics of the internal combustion engine in accordance with the embodiment of the present invention.

When a relationship between value of F/D and fuel consumption rate is examined on the basis of results derived from a number of experiments conducted with respect to the internal combustion engine having the deep-bottomed type combustion chamber as shown in FIG. 1, a graph in FIG. 4 is obtained which represents that the engine has the lowest fuel consumption rate in the range represented by $0.5 < F/D < 0.7$ which is determined in accordance with the inequality (4). In other words, the engine has a high combustion efficiency.

Figure 5:
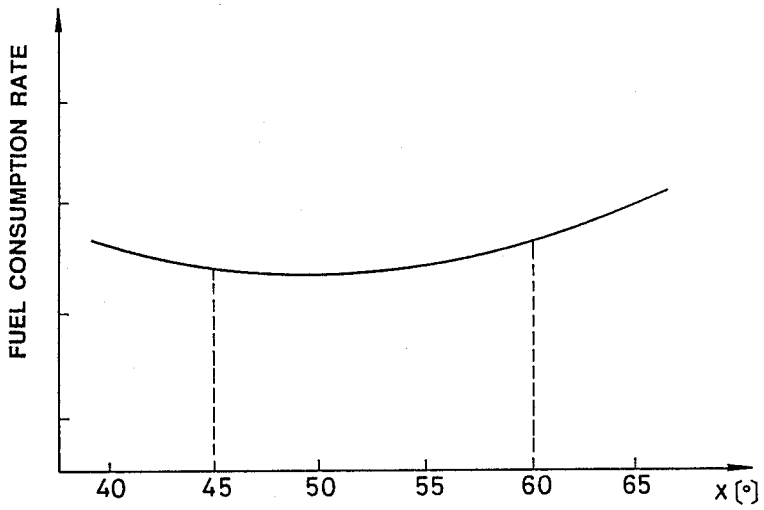

In addition, when a relationship between angle X° assumed by the injection holes 4 arranged in the lower row B and fuel consumption rate is likewise examined on the basis of results derived from a number of experiments, a graph in FIG. 5 is obtained which represents that the engine exhibits the lowest fuel consumption rate in the range represented by $45° < X < 60°$ which is determined in accordance with the inequality (2).

Figure 6:
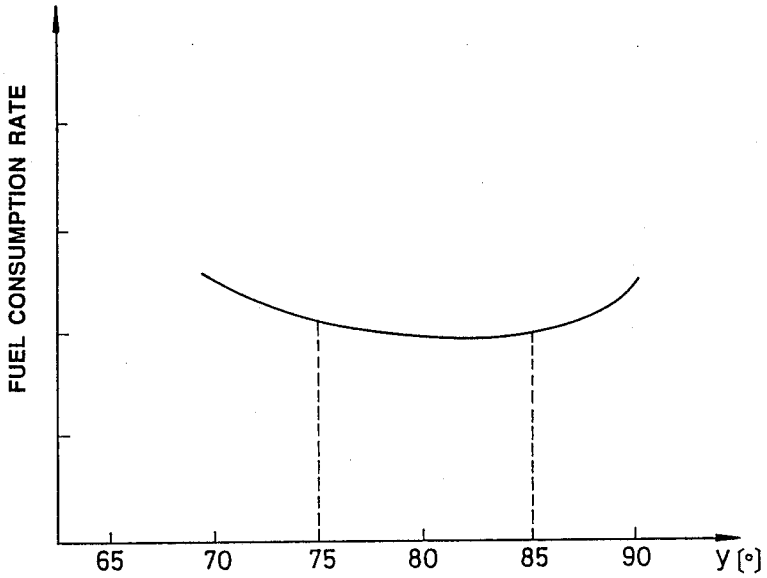

Additionally, when a relationship between angle Y° assumed by the injection holes 4 arranged in the upper row A and fuel consumption rate is examined on the basis of results derived from a number of experiments, a graph in FIG. 6 is obtained which represents that the engine exhibits the lowest fuel consumption rate in the range represented by $75° < Y° < 85°$ which is determined in accordance with the inequality (3).

As will be apparent from the above description, since the foregoing embodiment is practiced such that the engine has an increased total area assumed by the injection holes compared with that of the conventional engine and a depth of cavity is determined more than that of the conventional non-swirl type combustion chamber, it is assured that a period of fuel injection time is shortened, uniformity of distribution of sprayed fuel in the combustion chamber is improved further and a fuel combustion efficiency is increased further.

By virtue of the arrangement that a center of circle round which the injection holes are arranged in the upper row is spaced away from a center of circle round which the injection holes are arranged in the lower row, by a predetermined distance as viewed in the direction of extension of the center axis of the injection nozzle, starting positions R and R of the injection holes arranged in two rows in that way are spaced from one another while maintaining a certain distance therebetween (see FIG. 3). Consequently, a danger of causing a crack between the adjacent injection holes after the injection nozzle is used for a long period of time can be reduced as far as possible and thereby an internal combustion engine having a remarkably improved durability can be provided.

By the way, due to a fact that a configuration assumed by the combustion chamber of a piston in an internal combustion engine is unavoidably determined in dependence on a load exerted on the piston, in some case, a sectional contour (exhibiting a deep-bottomed tray shape) of the piston having considerably large magnitude of cavity depth can not necessarily be determined for the internal combustion engine as shown in FIG. 1.

In general, as an engine generates an increased output, a thermal load active on the piston increases, causing the cavity in a combustion chamber to unavoidably have a reduced depth. Accordingly, as the thermal load increases further, the upper end part of the combustion chamber tends to exhibit an expanded shape.

According to the embodiment of the present invention as shown in FIG. 1, a deep-bottomed tray type cavity for the combustion chamber assures an improved uniform distribution of injected fuel and prevents an occurrence of cracking on the nozzle having a number of injection holes formed thereon as far as possible. However, it should of course be understood that the present invention should not be limited only to the foregoing embodiment. Alternatively, the present invention may be applied to a case where a cavity for the combustion chamber has a reduced depth while assuring an uniform distribution of injected fuel and preventing an occurrence of cracking on the nozzle having a number of injection holes formed thereon.

Next, description will be made below as to an internal combustion engine in accordance with other embodiment of the present invention wherein a shallow-bottomed tray type cavity serving as a combustion chamber has a reduced depth.

Figure 7:
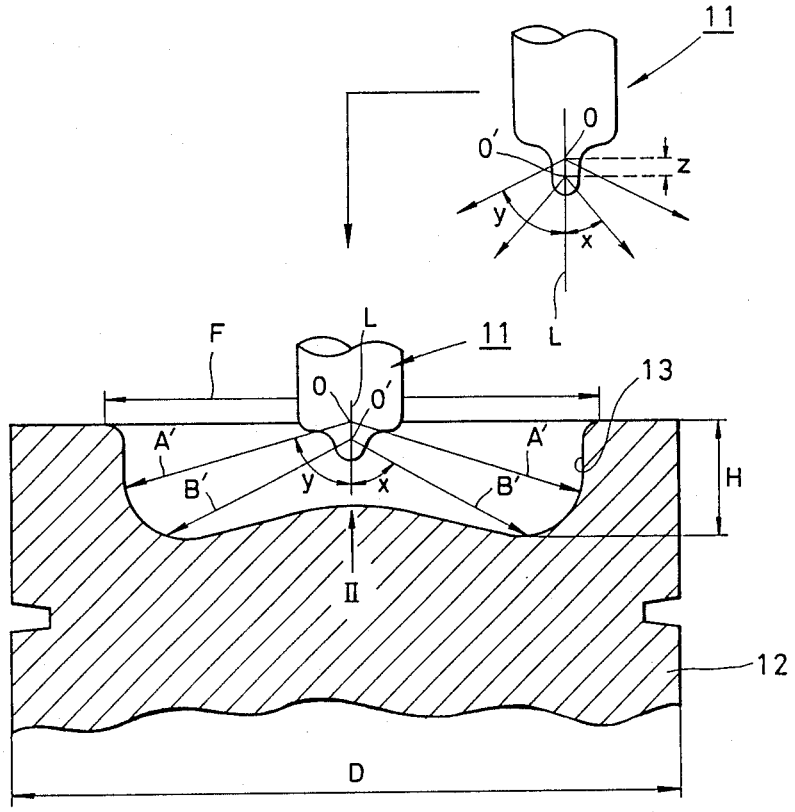
FIG. 7 is a fragmental sectional view illustrating an essential part of an internal combustion engine in accordance with other embodiment of the present invention.

FIG. 7 is a fragmental sectional view illustrating an essential part of an internal combustion engine in accordance with the other embodiment of the present invention and particularly illustrating in more details a combustion chamber and an injection nozzle.

This internal combustion engine is a direct fuel injection type diesel engine which includes a piston 12 just beneath an injection nozzle 11. The piston 12 is formed with a cavity at its upper part which constitutes a shallow-bottomed tray type combustion chamber 13.

Figure 8:
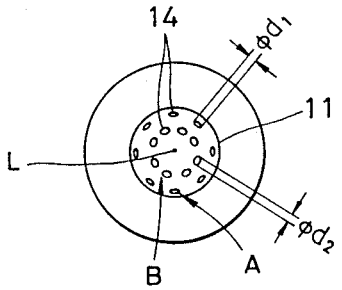
FIG. 8 is a plan view of an injection nozzle as seen in the direction identified by an arrow mark II in FIG. 7.

As will be apparent from FIG. 8 which is a plan view as seen in the direction identified by an arrow mark II in FIG. 7, a plurality of injection holes 14 arranged on the periphery of the fore end part of the injection nozzle 11 in two rows concentrically relative to the center axis L of the injection nozzle 11 are formed in such a manner that the injection holes 14 on the upper row A are arranged in a zigzag fashion relative to those on the lower row B. In addition, as will be apparent from FIG. 9 which is a sectional view of the fore end part of the injection nozzle 11 shown in FIG. 7, the radially extending injection holes 14 on the upper row A are formed at a predetermined pitch on the periphery of a circle of which center is located at a position O on the center axis L of the injection nozzle 11, while the radially extending injection holes 14 on the lower row B are formed at a predetermined pitch on the periphery of a circle of which center is located at a position O′ on the center axis L of the injection nozzle 11. The position O is spaced away from the position O′ by a predetermined distance Z. Incidentally, in the illustrated embodiment, the injection holes 14 having number in the range of 10 to 16 in total are formed on the injection nozzle 11.

Figure 9:
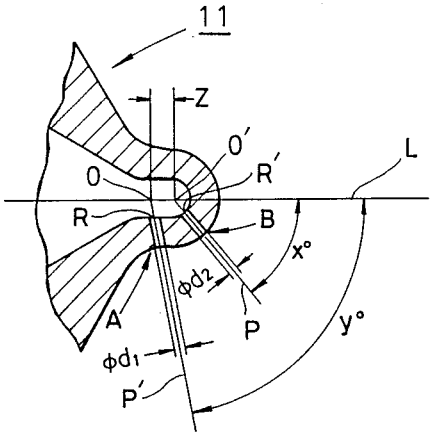
FIG. 9 is a fragmental sectional view illustrating the fore end part of the injection nozzle shown in FIG. 8.

As shown in FIG. 9, according to the foregoing embodiment, the injection centers O and O′ for the injection nozzle 11 are spaced away from one another by a distance Z on the center axis L of the injection nozzle 11 on the assumption that the fore end part of the injection nozzle 11 exhibits a cylindrical configuration. Concretely speaking, the distance Z is determined in accordance with the following relationship when it is assumed that a diameter of the respective injection holes in the upper row is represented by $d_1$ and a diameter of the respective injection holes in the lower row B is represented by $d_2$.

$$d_1 \geqq d_2 \quad (5)$$

and $$d_1 < Z < d_2 \quad (6)$$

As shown in FIG. 9, in the foregoing embodiment, angles assumed by center axes P and P of the injection holes 14 relative to the center axis L of the injection nozzle 11 are determined in accordance with the following relationships when an angle assumed by the respective injection holes in the lower row B is represented by X° and an angle assumed by the respective injection holes in the upper row A is represented by Y°.

$$55° \leqq X \leqq 70° \quad (7)$$

$$75° \leqq Y \leqq 80° \quad (8)$$

Consequently, fuel injected through the injection holes 14 arranged on two upper and lower rows is distributed within a comparatively wide range extended round the center axis L of the injection nozzle 11 as identified by arrow marks A' and B'. Thus, according to the foregoing embodiment, a depth H of the cavity can be determined less than that of a conventional non-swirl type combustion chamber.

Incidentally, in the embodiment shown in FIG. 7, the range assumed by a value of diameter of cavity/diameter of bore=F/D is determined in accordance with the following relationship.

$$0.05 \leqq F/D \leqq 0.80 \quad (9)$$

Moreover, a ratio H/F of depth H of the combustion chamber to diameter F of the cavity is determined in accordance with the following relationship.

$$H/F < 0.45 \quad (10)$$

Figure 10:
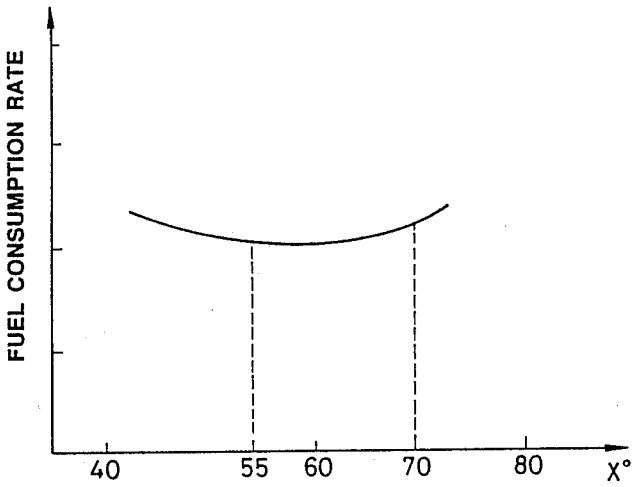
FIGS. 10 to 12 are a graph respectively, representing characteristics of the internal combustion engine in accordance with the other embodiment of the present invention.

When a relationship between angle X° assumed by the injection holes 14 in the lower row B and fuel cost rate is examined on the basis of results derived from a number of experiments conducted with respect to an internal combustion engine having a shallow-bottomed tray type combustion chamber as shown in FIG. 7, a graph in FIG. 10 is obtained which represents that the range identified by $55° \leqq X \leqq 70°$ in accordance with the inequality (7) exhibits the lowest fuel consumption rate. In other words, it exhibits a high combustion efficiency.

Figure 11:
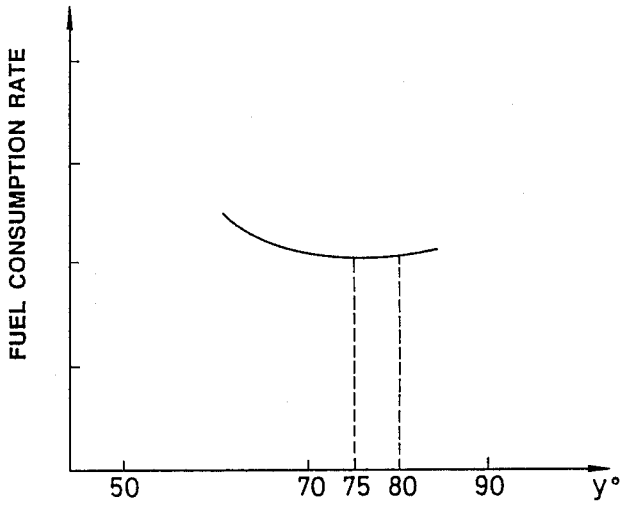

In addition, when a relationship between angle Y° assumed by the injection holes 14 in the upper row A and fuel consumption rate is likewise examined on the basis of results derived from a number of experiments, a graph in FIG. 11 is obtained which represents that the range identified by $75° \leqq Y \leqq 80°$ in accordance with the inequality (8) exhibits the lowest fuel consumption rate.

Figure 12:
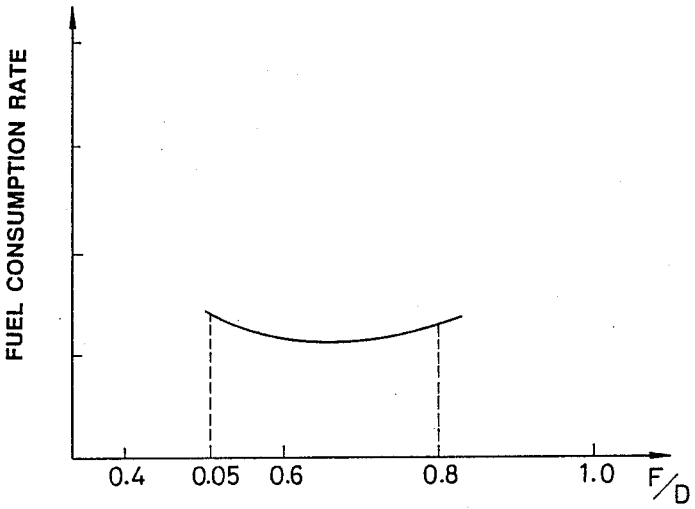
Figure 13:
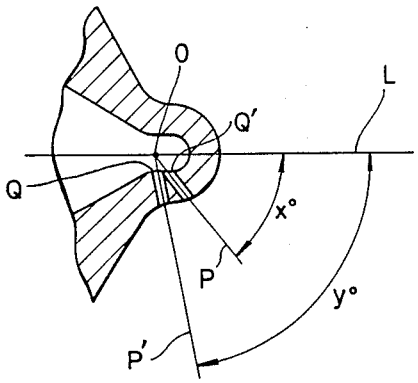
FIG. 13 is a fragmental sectional view illustrating an essential part of a injection nozzle usable for a conventional internal combustion engine.

Additionally, when a relationship between value of F/D and fuel consumption rate is examined on the basis of results derived from a number of experiments, a graph in FIG. 12 is obtained which represents that the range identified by $0.05 \leqq F/D \leqq 0.80$ in accordance with the inequality (9) exhibits the lowest fuel consumption rate. In other words, it exhibits a high combustion efficiency.

As will be readily apparent from the above description, according to the aforementioned second embodiment, by selecting the number of injection holes and a diameter of each of the injection holes within a properly determined range, a period of fuel injection time can be shortened corresponding to a reduced depth of the cavity for the combustion chamber accompanied by an increased output from the engine, uniformity of distribution of injected fuel within the interior of the combustion chamber can be improved and a combustion efficiency can be increased further.

Since a center of circle in the upper row round which a series of injection holes are arranged is offset along the center axis L of the injection nozzle 11 by a predetermined distance Z from a center of circle in the lower row round which a series of injection holes are arranged, this assures that starting positions R and R' of injection holes arranged in two rows are located while maintaining a certain distance therebetween (see FIG. 9). Consequently, a danger that a crack may occur between adjacent injection holes after the injection nozzle is used for a long period of time can be reduced as far as possible whereby an internal combustion engine having u remarkably improved durability can be provided.

While the present invention has been described above with respect to two preferred embodiments, it should of course be understood that it should not be limited only to them but various changes or modifications may be made in a suitable manner without any departure from the scope of the invention as defined by the appended claims.

INDUSTRIAL APPLICABILITY

As described hereinbefore, an internal combustion engine in accordance with the present invention is suitably employable for such an internal combustion engine that improvement on fuel consumption rate and output, and particularly, durability for a long period of time are required.

We claim:

1. An internal combustion engine including a fuel injection device for feeding fuel in the interior of a combustion chamber through an injection nozzle, characterized in that said injection nozzle is formed with a plurality of injection holes arranged in two rows concentrically relative to the center axis of the injection nozzle, the respective injection holes in the upper row being arranged in a zigzag fashion relative to those in the lower rows, radially extending center axes of the respective injection holes in the upper row are arranged on the periphery of a circle of which center is located at a position on the center axis of the injection nozzle and radially extending center axes of the respective injection holes arranged in the lower row are arranged on the periphery of a circle of which center is located at a position on the center axis of the injection nozzle, said position being spaced away from said position by a predetermined distance Z, wherein the number of injection holes arranged in both the upper and lower rows is determined in the range of 14 to 20 in total and when it is assumed that a diameter of the respective injection holes is represented by d, the following conditions are satisfactorily met among a plurality of parameters comprising said distance Z, an angle X° assumed by center axes of the injection holes in the lower row relative to the center axis of the injection nozzle, an angle Y° assumed by center axes of the injection holes in the upper row relative to the center axis of the injection nozzle and a ratio F/D of diameter F of a cavity for the combustion chamber to diameter D of a bore (I) $d < Z < 4d$ (II) $45° < X° < 60°$ (III) $75° < Y° < 85°$ (IV) $0.5 < F/D < 0.7$.

2. An internal combustion engine as claimed in claim 1, characterized in that said internal combustion engine is a direct fuel injection type diesel engine.

3. An internal combustion engine including a fuel injection device for feeding fuel in the interior of a combustion chamber through an injection nozzle, characterized in that said injection nozzle is formed with a plurality of injection holes arranged in two rows concentrically relative to the center axis of the injection nozzle, the respective injection holes in the upper row being arranged in a zigzag fashion relative to those in the lower row, radially extending center axes of the respective holes in the upper row are arranged on the periphery of a circle of which center is located at a position on the center axis of the injection nozzle and radially extending center axes of the respective injection hole in the lower row are arranged on the periphery of a circle of which center is located at a position on the center axis of the injection hole, said position being spaced away from said position by a predetermined distance Z, wherein the number of injection holes arranged in both the upper and lower rows is determined in the range of 10 to 16 in total and when it is assumed that a diameter of the respective injection holes in the upper row is represented by $d_1$ and a diameter of those in the lower row is represented by $d_2$, the following conditions are satisfactorily met among a plurality of parameters comprising said distance Z from the injection holes having diameter $d_1$ to those having diameter $d_2$, an angle X° assumed by the center axes of the injection holes in the lower row relative to the center axis of the injection nozzle, an angle Y°. assumed by the center axes of the injection holes in the upper row relative to the center axis of the injection nozzle, a ratio F/D of diameter F of a cavity for the combustion chamber to diameter D of a bore and a ratio H/D of depth H of the cavity to diameter F of the cavity (I) $d_1 \geqq d_2$
(II) $d_1 < Z < 5d_1$
(III) $55° \leqq X° \leqq 70°$
(IV) $75° \leqq Y° \leqq 80°$
(V) $0.05 \leqq F/D \leqq 0.80$
(Vl) $H/F < 0\ 45$.

4. An internal combustion engine as claimed in claim 3, characterized in that said internal combustion engine is a direct fuel injection type diesel engine.

* * * * *